US005779321A

United States Patent [19]

Coleman et al.

[11] Patent Number: 5,779,321

[45] Date of Patent: Jul. 14, 1998

[54] SWING TAIL ASSEMBLY FOR MINER

[75] Inventors: George E. Coleman, Bristol, Tenn.; Michael R. Walker, Bristol, Va.

[73] Assignee: Arch Technology Corporation, St. Louis, Mo.

[21] Appl. No.: 747,446

[22] Filed: Nov. 12, 1996

[51] Int. Cl.[6] ..... E21C 31/10; E21C 35/20

[52] U.S. Cl. ..... 299/64; 198/861.2

[58] Field of Search ..... 299/64, 73, 75, 299/39.2; 198/313, 861.2

[56] References Cited

U.S. PATENT DOCUMENTS

| | | | |
|---|---|---|---|
| 2,654,586 | 10/1953 | Berry | 299/73 |
| 4,159,055 | 6/1979 | Eberle | 198/512 |
| 4,192,551 | 3/1980 | Weimer et al. | 299/1.4 |
| 4,844,548 | 7/1989 | Masovich et al. | 299/43 |
| 5,190,352 | 3/1993 | LeBegue et al. | 299/64 X |
| 5,192,116 | 3/1993 | Turner et al. | 299/75 |

*Primary Examiner*—David J. Bagnell

*Attorney, Agent, or Firm*—Webb Ziesenheim Bruening Logsdon Orkin & Hanson, P.C.

[57] ABSTRACT

A swing tail assembly rotates a swing tail conveyor relative to a miner conveyor including a mounting assembly mounting a drive arrangement on a swing tail conveyor. The drive arrangement includes a hydraulic motor, a differential planetary speed reducer and a sprocket connected to said differential planetary speed reducer. A fixed pin/rack arrangement is connected to the fan section of the miner conveyor and the sprocket cooperates with the pin/rack arrangement to rotate the swing tail conveyor relative to the miner conveyor.

19 Claims, 3 Drawing Sheets

SWING TAIL ASSEMBLY FOR MINER

BACKGROUND OF THE INVENTION

1. Field of the Invention

The invention relates generally to a continuous miner having an articulated swing tail conveyor pivotally connected to the outby end and, more particularly, to a swing tail assembly mounted at the outby end of the miner for adjusting the angular position of the swing tail conveyor relative to the longitudinal axis of the miner.

The invention has a variety of applications wherever loose material is transferred from a conveyor on a machine such as a cutting machine onto a conveyor on another machine or onto a haulage conveyor. The invention is described hereinafter in connection with a drum type continuous miner but is not limited to use with such a machine.

Briefly, this type of miner consists of a frame mounted on crawlers for tramming along a mine floor and for sumping the cutting drum into a mine face. The cutting drum has a plurality of cutting elements removably mounted thereon and is mounted for rotation on its transverse axis at the inby end of the miner frame. The drum is rotatably mounted on the free ends of parallel support arms which are pivotally mounted on the frame. The cutting elements on the drum cut the full height of the coal seam between the floor and the roof by pivoting the arms relative to the frame to raise and lower the rotary drum.

The miner includes a gathering pan located at the front of the frame below the cutting drum which collects the mined material. Gathering heads are mounted above the pan to direct the loose mined material onto a centrally located conveyor extending rearwardly from the inby end of the miner to the outby end of the miner. The loose material is transferred to a swing tail conveyor at the outby end of the central conveyor so that it can be directed to other haulage equipment to move it to either another location into or out of the mine.

2. Summary of the Invention

The invention is a swing tail assembly for a swing tail conveyor which is in operative communication with the outby end of the central conveyor on the miner. The swing tail conveyor is pivoted about a pin to permit the free end of the swing tail conveyor to move relative to the longitudinal axis of the miner. The pivot pin has a substantially vertical axis so that the outlet end of the swing tail conveyor can be adjusted through an arc relative to the outby end of the miner to direct loose material from the miner conveyor onto the conveyor on another machine or onto a haulage system located in the mine.

The swing tail assembly of the invention is inexpensive and mechanically simple and requires minimal maintenance. The swing tail assembly consists of a stationary pin/rack arrangement on the fan section of the outby end of the miner conveyor and a rotary drive pinion on the inby end of the swing tail conveyor which cooperates with the pin/rack arrangement to pivot the swing tail conveyor about the pivot pin relative to the outby end of the miner conveyor.

A complete understanding of the invention will be obtained from the following description when taken in connection with the accompanying drawing figures wherein like reference characters identify like parts throughout.

DESCRIPTION OF THE PREFERRED EMBODIMENT

Figure 2:
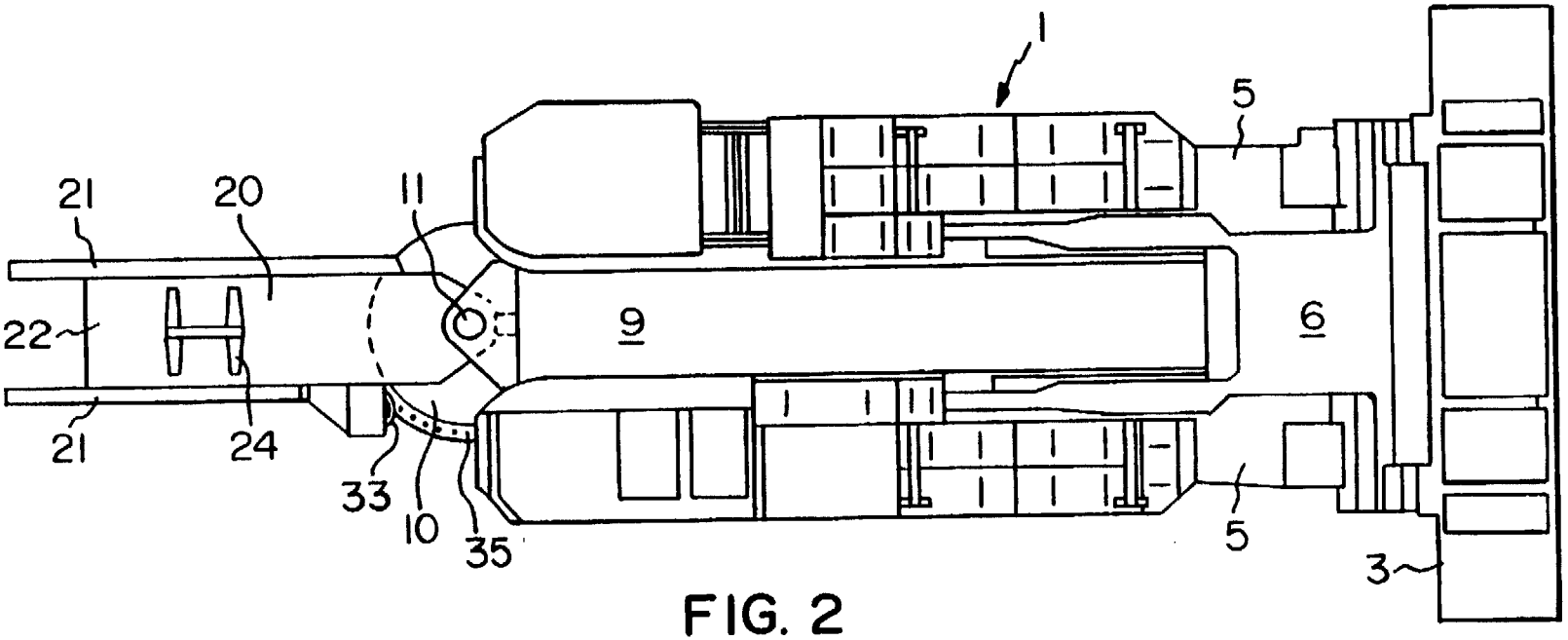
FIG. 2 is a plan view of the continuous miner shown in FIG. 1.
Figure 1:
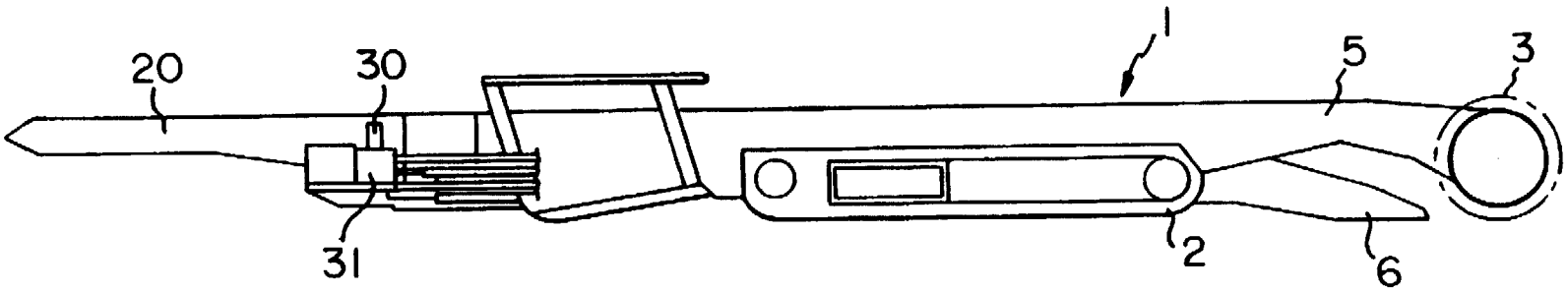
FIG. 1 is a side elevation of a continuous miner having a swing tail conveyor mounted thereon.
Figure 3:
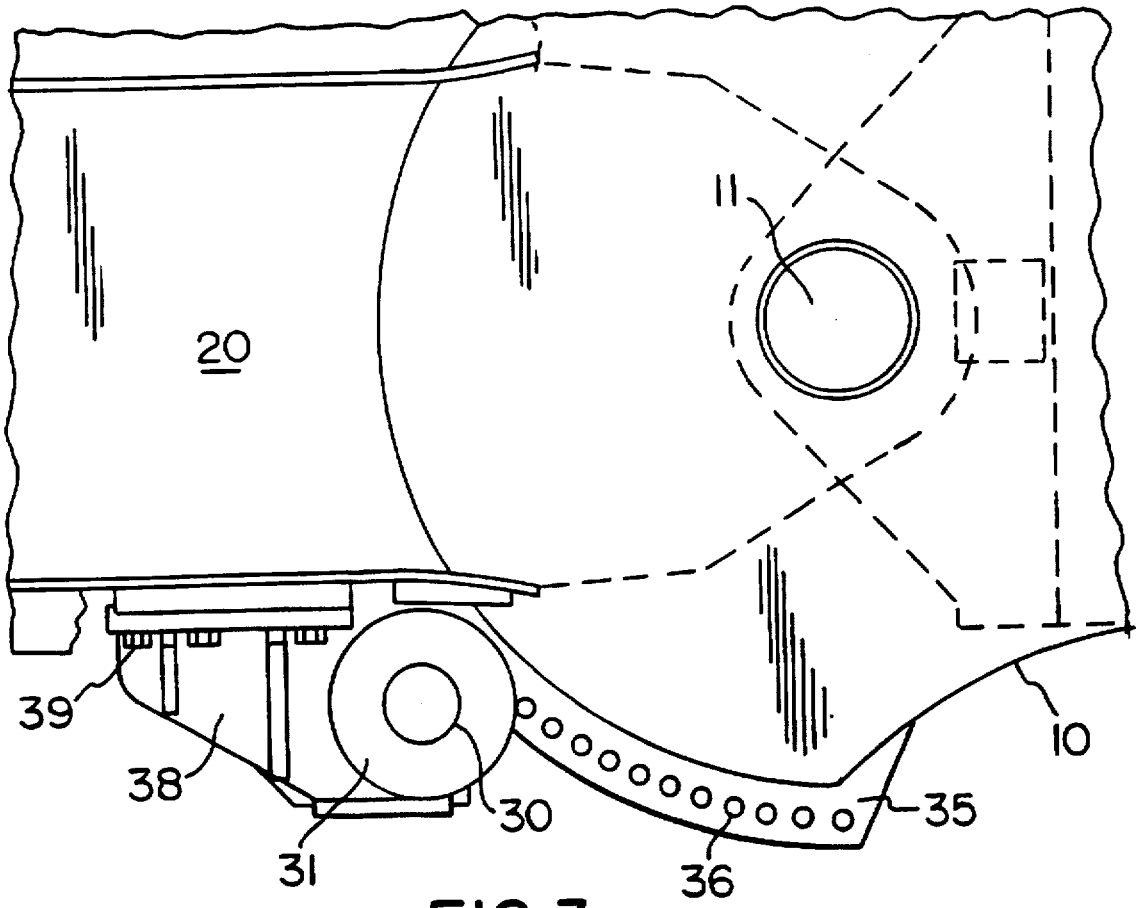
FIG. 3 is a plan view of the fan section of the outby end of the miner conveyor and the inby end of the swing tail conveyor pivotally connected thereto.
Figure 4:
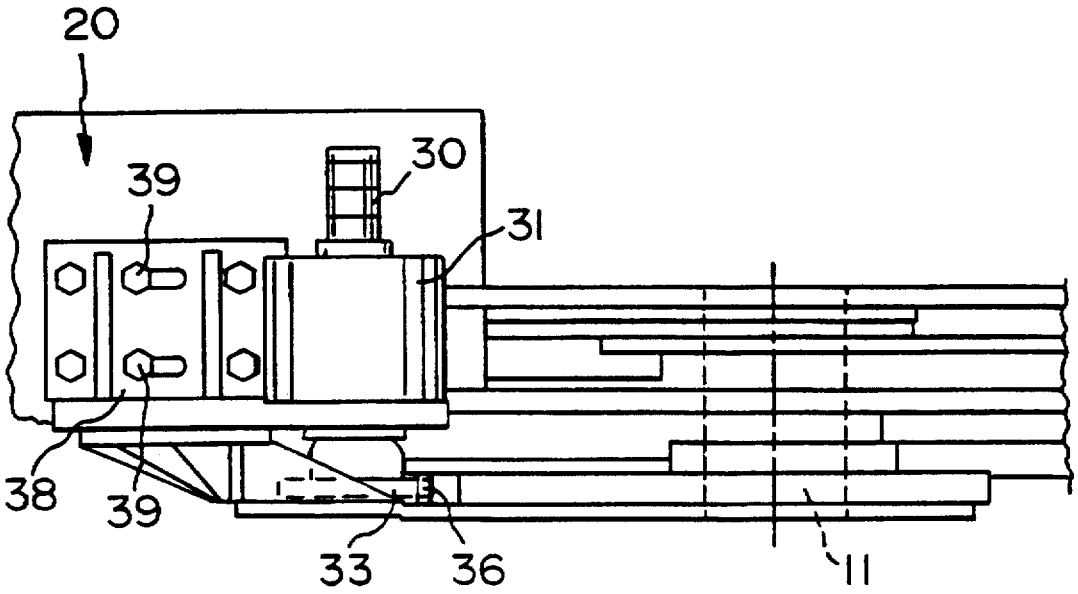
FIG. 4 is a side elevation of the swing tail assembly.
Figure 5:
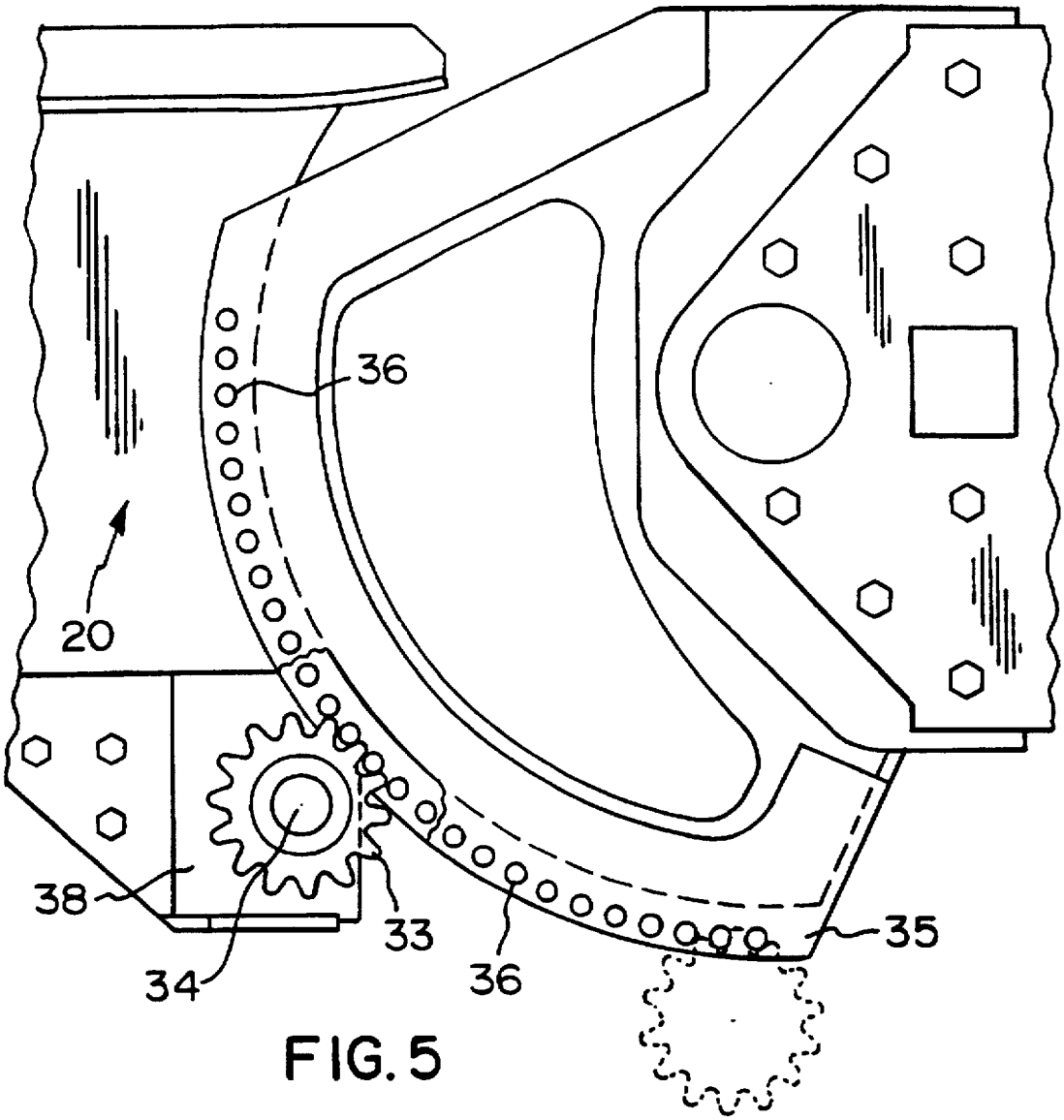
FIG. 5 is a plan view of the swing tail assembly.
Figure 6:
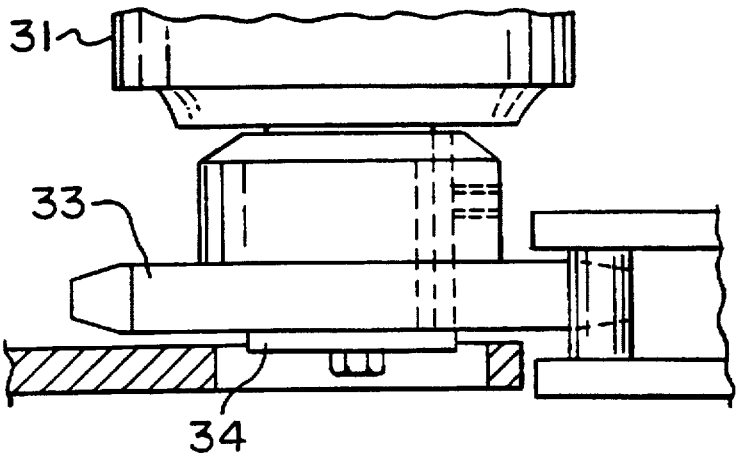
FIG. 6 is a side elevation of the drive pinion of the swing tail assembly.

With reference to FIGS. 1 and 2 of the drawings, the continuous miner 1 is mounted on crawlers 2 and has a horizontal, rotary cutting drum 3 at its forward end with cutting bits thereon (not shown). The drum is mounted on the ends of a pair of spaced arms 5 which are pivotally mounted on the machine frame for movement in an arc to raise and lower the drum 3 to cut coal from the face between the floor and the roof of the mine. A gathering pan 6 is located below and slightly behind the drum 3 to collect the coal which is mined from the face. The pan 6 will have gathering arms or discs mounted therein which move the mined coal centrally and rearwardly to the inby end of a central conveyor 9 which is located between the crawlers 2 and extends from the pan 6 to the outby end of the miner 1. The outby end of the conveyor 9 is formed with a fan section 10 and the swing tail conveyor 20 is pivotally mounted on the fan section 10 by a vertical pivot pin 11 which extends through the fan section 10 of the miner conveyor 9 and through the inby end of the swing tail conveyor 20 to connect the two for relative arcuate movement of the swing tail conveyor relative to the longitudinal axis of the miner.

As shown in FIGS. 3–6 of the drawings, the swing tail conveyor consists of a frame having spaced side members 21 and a bottom plate 22 between the side members. A continuous chain conveyor 24 extends between the side members 21 along the length of the swing tail conveyor. The central conveyor 9 on the miner 1 moves coal rearwardly from the gathering pan 6 onto the inby end of the swing tail conveyor from where it is transported rearwardly away from the miner to another haulage system to move it to another location in the mine or out of the mine. The pivotal adjustment of the outby end of the swing tail conveyor makes it possible to deposit mined coal at locations away from the outby end of the miner 1 which are not longitudinally aligned with the miner conveyor. Thus, the swing tail conveyor pivots about the pivot pin 11 through an arc of approximately 45° on each side of the longitudinal central axis of the miner conveyor 9 to adjust the location of the outby end of the swing tail conveyor relative to the outby end of the miner conveyor.

The swing tail assembly pivots the swing tail conveyor about the pivot pin 11 for articulation in a substantially horizontal plane. The swing tail assembly is a compact arrangement which replaces the traditional prior art hydraulic cylinder used to pivot the swing tail conveyor. The elimination of the hydraulic cylinder permits the miner to operate in a more limited space and with a smoother articulation motion of the swing tail conveyor than is possible using the prior art hydraulic cylinder to adjust the swing tail conveyor.

The swing tail assembly shown in FIGS. 3–6 of the drawings includes a hydraulic motor 30 having a vertical drive shaft, a differential planetary speed reducer 31 and a sprocket 33, all of which are mounted on an adjustable motor mounting assembly 38 mounted on the inby end of the swing tail conveyor 20. A sprocket retainer cap 34 is fixed on the lower end of the drive shaft of the differential planetary speed reducer 31 to hold the sprocket 33 in place on the shaft. The sprocket 33 is fixed to rotate with the shaft of the differential planetary speed reducer 31 by keys and/or set screws. A pin/rack arrangement 35 is attached to the fan section 10 of the miner conveyor 9.

The pin/rack arrangement 35 shown in the drawings has 26 substantially vertical pins 36 spaced approximately two radial degrees apart extending in an arc of approximately 90° of a circle on the fan section of the miner conveyor 10. Thus, rotation of the sprocket 33 will cause relative rotation of the outby end of the swing tail conveyor through an arc of approximately 45° in each direction relative to the longitudinal central axis of the miner. It will be understood by those skilled in the art that the number of pins and the degrees of spacing between adjacent pins will vary in accordance with the number of degrees in the arc through which the swing tail conveyor is to rotate.

The hydraulic motor 30 is a low speed, high torque motor which powers the differential planetary speed reducer 31. The speed reducer drives a drive shaft which carries the sprocket 33. The sprocket teeth travel around the stationary pin/rack arrangement 35 to pivot the swing tail conveyor 20 about the pivot pin 11. The swing tail assembly utilizes the same hydraulic power supply and return hoses that are present on a miner having a hydraulic cylinder to pivot the swing tail conveyor and, hence, redesign of the hydraulic system is not required to install a swing tail assembly according to the invention on a miner. A direct interchange of the hydraulic motor may be made for the hydraulic cylinder. If desired, a flow control valve may be connected in the hydraulic system to vary the speed of the hydraulic motor to adjust the speed of rotation of the swing tail conveyor about the pivot pin 11.

The planetary speed reducer 31 is mounted on a motor mounting assembly 38 which is adjustably mounted on the inby end of the swing tail conveyor 20 by bolts 39 to locate the sprocket relative to the pin/rack arrangement 35 on the fan section 10 of the central miner conveyor 9. The adjustable mounting of the motor mounting assembly 38 permits the sprocket 33 to be accurately located relative to the pin/rack arrangement 35 on the fan section 10.

It will be understood by those skilled in the art that the swing tail assembly provides an efficient and relatively inexpensive arrangement to pivot the swing tail conveyor 20 about the pivot pin 11. The assembly requires a minimum of space so that the assembly does not extend laterally beyond the dimensions of the fan section of the miner conveyor and interfere with the operation of the miner. The swing tail assembly provides a substantial degree of articulated movement of the swing tail conveyor in the horizontal plane.

In the foregoing description, it will be readily appreciated by those skilled in the art that modifications may be made to the invention without departing from the concepts disclosed herein. Such modifications are to be considered as included within the following claims, unless the claims by their language expressly state otherwise. Accordingly, the particular embodiments are illustrative only and are not limiting as to the scope of the invention which is to be given the full breadth of the appended claims and any and all equivalents thereof.

What is claimed is:

1. A swing tail assembly for rotating a swing tail conveyor relative to a miner having a central conveyor with an outby end having a fan section, said swing tail assembly including:

a motor mounting assembly for mounting on a swing tail conveyor;

a drive arrangement mounted on said motor mounting assembly, said drive arrangement including a hydraulic motor, a differential planetary speed reducer and a sprocket operatively connected to said differential planetary speed reducer;

a fixed pin/rack arrangement adapted to be mounted on a fan section of a miner conveyor;

whereby said sprocket cooperates with said fixed pin/rack arrangement to rotate a swing tail conveyor relative to a fan section of a miner conveyor.

2. A swing tail conveyor assembly as set forth in claim 1 wherein said drive arrangement includes a differential planetary speed reducer located between said hydraulic motor and said sprocket and a drive shaft operatively connecting said speed reducer to said sprocket to rotate said sprocket.

3. A swing tail conveyor assembly as set forth in claim 1 wherein said pin/rack arrangement extends over an arc of approximately 90°.

4. A swing tail assembly for rotating a swing tail conveyor relative to a miner having a central conveyor with an outby end having a fan section, said swing tail assembly including:

a motor mounting assembly for mounting on a swing tail conveyor;

a drive arrangement mounted on said motor mounting assembly, said drive arrangement including a hydraulic motor, a differential planetary speed reducer and a sprocket operatively connected to said differential planetary speed reducer; and a fixed pin/rack arrangement adapted to be mounted on a fan section of a miner conveyor, whereby said sprocket cooperates with said fixed pin/rack arrangement to rotate a swing tail conveyor relative to a fan section of a miner conveyor, and wherein said pin/rack arrangement includes a plurality of spaced substantially vertical pins arranged in an arc.

5. A swing tail conveyor assembly as set forth in claim 4 wherein said pin/rack arrangement includes 26 spaced pins.

6. A swing tail conveyor assembly as set forth in claim 4 wherein each of said plurality of pins is spaced approximately two degrees from each adjacent pin.

7. A swing tail conveyor assembly as set forth in claim 4 wherein said plurality of pins are spaced approximately two degrees apart.

8. A continuous miner having an inby end and an outby end, a rotary cutting drum adjustably mounted at said inby end, a centrally located conveyor extending from said inby end to said outby end, a fan section on said outby end of said centrally located conveyor, a pin/rack arrangement fixed to said fan section of said miner conveyor, a substantially vertical pivot pin extending through said fan section, a swing tail conveyor having an outby end and an inby end pivotally mounted on said pivot pin for articulated motion about said pivot pin and said miner conveyor in a substantially horizontal plane, a swing tail assembly for rotating said swing tail conveyor about said pivot pin, said swing tail assembly including rotary drive means mounted on said swing tail conveyor for contacting said pin/rack arrangement on said fan section, and power means for rotating said rotary drive means, whereby said rotary drive means engages said fixed pin/rack arrangement and rotation of said rotary drive means by said power means rotates said swing tail conveyor about said pivot pin to adjust the location of said outby end of said swing tail conveyor in a horizontal plane.

9. A continuous miner as set forth in claim 8 wherein said power means includes a hydraulic motor, a differential planetary speed reducer operatively connected to said hydraulic motor and said rotary drive means is operatively connected to said differential planetary speed reducer to rotate said rotary drive means.

10. A continuous miner as set forth in claim 9 wherein said rotary drive means is a sprocket.

11. A continuous miner as set forth in claim 8 wherein said pin/rack arrangement extends over an arc of approximately 90° of the periphery of said fan section of said miner conveyor.

12. A continuous miner, comprising:

an inby end and an outby end;

a rotary cutting drum adjustable mounted at said inby end;

a centrally located conveyor extending from said inby end to said outby end;

a fan section on said outby end of said centrally located conveyor;

a pin/rack arrangement fixed to said fan section of said miner conveyor;

a substantially vertical pivot pin extending through said fan section;

a swing tail conveyor having an outby end and an inby end pivotally mounted on said pivot pin for articulated motion about said pivot pin and said miner conveyor in a substantially horizontal plane;

a swing tail assembly for rotating said swing tail conveyor about said pivot pin, said swing tail assembly including rotary drive means mounted on said swing tail conveyor for contacting said pin/rack arrangement on said fan section, and power means for rotating said rotary drive means, whereby said rotary drive means engages said fixed pin/rack arrangement and rotation of said rotary drive means by said power means rotates said swing tail conveyor about said pivot pin to adjust the location of said outby end of said swing tail conveyor in a horizontal plane, and wherein said pin/rack arrangement includes a plurality of spaced substantially vertical pins arranged in an arc.

13. A continuous miner as set forth in claim 12 wherein said pin/rack arrangement includes 26 spaced pins.

14. A continuous miner as set forth in claim 13 wherein each of said plurality of pins is spaced approximately two degrees from each adjacent pin.

15. A continuous miner as set forth in claim 12 wherein said plurality of pins are spaced approximately two degrees apart.

16. A swing tail assembly for rotating a swing tail conveyor relative to a miner having a central conveyor with an outby end having a fan section, said swing tail assembly including:

a mounting assembly for mounting said swing tail assembly on a swing tail conveyor;

a drive arrangement on said mounting assembly, said drive arrangement including a hydraulic motor and a sprocket; and a fixed pin/rack arrangement;

whereby said sprocket cooperates with said fixed pin/rack arrangement for rotating the swing tail conveyor relative to the miner conveyor.

17. A swing tail conveyor assembly as set forth in claim 16 wherein said pin/rack arrangement is adapted to be connected to the fan section of the miner conveyor.

18. A swing tail conveyor assembly as set forth in claim 16 wherein said pin/rack arrangement includes a plurality of spaced pins configured to engage said sprocket.

19. A swing tail conveyor assembly as set forth in claim 18 wherein said pins are arranged in an arc.

* * * * *

UNITED STATES PATENT AND TRADEMARK OFFICE

CERTIFICATE OF CORRECTION

PATENT NO. : 5,779,321

DATED : July 14, 1998

INVENTOR(S) : George E. Coleman and Michael R. Walker

It is certified that error appears in the above-identified patent and that said Letters Patent is hereby corrected as shown below:

Column 3 Line 10 "26" should read --26-- (delete bold).

Claim 6 Column 4 Line 40 "set forth in claim 4" should read --set forth in claim 5--.

Signed and Sealed this

Tenth Day of November 1998

*Attest:*

*Attesting Officer*

BRUCE LEHMAN

*Commissioner of Patents and Trademarks*